US006430746B1

(12) United States Patent
Watson

(10) Patent No.: US 6,430,746 B1
(45) Date of Patent: Aug. 13, 2002

(54) ATHLETIC GLOVE POCKET FORMING DEVICE

(75) Inventor: Daryl L. Watson, Yreka, CA (US)

(73) Assignee: Watson Wrap, Inc., Eagle Point, OR (US)

( * ) Notice: Subject to any disclaimer, the term of this patent is extended or adjusted under 35 U.S.C. 154(b) by 0 days.

(21) Appl. No.: 09/931,808

(22) Filed: Aug. 17, 2001

(51) Int. Cl.[7] ..... A41D 13/08
(52) U.S. Cl. ..... 2/19
(58) Field of Search ..... 2/16, 19, 159, 2/160, 161.1; 206/315.1, 315.9; 223/66, 78, 79, 80, 84; D29/115, 123

(56) References Cited

U.S. PATENT DOCUMENTS

| | | | | | |
|---|---|---|---|---|---|
| D256,519 | S | | 8/1980 | Hirsch | |
| 4,564,956 | A | | 1/1986 | Dibuono | |
| 4,765,519 | A | | 8/1988 | Groves | |
| 4,853,975 | A | | 8/1989 | Clevenhagen | |
| 4,883,170 | A | * | 11/1989 | Wright | 2/19 |
| 4,958,729 | A | * | 9/1990 | Wright | 2/19 |
| 5,000,317 | A | * | 3/1991 | Cich | 2/19 |
| 5,210,880 | A | | 5/1993 | Yale | |
| 5,267,677 | A | * | 12/1993 | Nash | 2/19 |
| 5,456,390 | A | * | 10/1995 | McFarland | 223/78 |
| D376,677 | S | * | 12/1996 | Boysen | D29/123 |
| 5,687,421 | A | | 11/1997 | Murai | |
| 5,758,805 | A | * | 6/1998 | Dunn | 2/19 |
| 5,810,215 | A | * | 9/1998 | Plymell | 223/78 |

* cited by examiner

*Primary Examiner*—John J. Calvert
*Assistant Examiner*—Gary L. Welch

(57) ABSTRACT

An athletic glove pocket forming device for facilitating the formation of a pocket in an athletic glove. The athletic glove pocket forming device includes an elastomeric panel member having a plurality of coupling members on opposing edges such that the panel member is designed for being wrapped around an athletic glove having a ball in the pocket portion for the purpose of better forming a pocket portion or protecting the glove from the environment.

19 Claims, 1 Drawing Sheet

ATHLETIC GLOVE POCKET FORMING DEVICE

BACKGROUND OF THE INVENTION

1. Field of the Invention

The present invention relates to athletic glove pocket forming devices and more particularly pertains to a new athletic glove pocket forming device for facilitating the formation of a pocket in an athletic glove.

2. Description of the Prior Art

The use of athletic glove pocket forming devices is known in the prior art. More specifically, athletic glove pocket forming devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,564,956; U.S. Pat. No. 5,687,421; U.S. Pat. No. 4,7.65,519; U.S. Pat. No. 4,853,975; U.S. Pat. No. 5,21.0,880; and U.S. Pat. No. Des. 256,519.

While these devices fulfill their respective, particular objectives and requirements, the aforementioned patents do not disclose a new athletic glove pocket forming device. The inventive device includes an elastomeric panel member having a plurality of coupling members on opposing edges such that the panel member is designed for being wrapped around an athletic glove having a ball in the pocket portion for the purpose of better forming the shape of the pocket portion, or protecting the glove from the environment.

In these respects, the athletic glove pocket forming device according to the present invention substantially departs from the conventional concepts and designs of the prior art, and in so doing provides an apparatus primarily developed for the purpose of facilitating the formation of a pocket in an athletic glove.

SUMMARY OF THE INVENTION

In view of the foregoing disadvantages inherent in the known types of athletic glove pocket forming devices now present in the prior art, the present invention provides a new athletic glove pocket forming device construction wherein the same can be utilized for facilitating the formation of a pocket in an athletic glove.

The general purpose of the present invention, which will be described subsequently in greater detail, is to provide a new athletic glove pocket forming device apparatus and method which has many of the advantages of the athletic glove pocket forming devices mentioned heretofore and many novel features that result in a new athletic glove pocket forming device which is not anticipated, rendered obvious, suggested, or even implied by any of the prior art athletic glove pocket forming devices, either alone or in any combination thereof.

To attain this, the present invention generally comprises an elastomeric panel member having a plurality of coupling members on opposing edges such that the panel member is designed for being wrapped around an athletic glove having a ball in the pocket portion for the purpose of better forming a pocket portion or protecting the glove from the environment.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new athletic glove pocket forming device apparatus and method which has many of the advantages of the athletic glove pocket forming devices mentioned heretofore and many novel features that result in a new athletic glove pocket forming device which is not anticipated, rendered obvious, suggested, or even implied by any of the prior art athletic glove pocket forming devices, either alone or in any combination thereof.

It is another object of the present invention to provide a new athletic glove pocket forming device which may be easily and efficiently manufactured and marketed.

It is a further object of the present invention to provide a new athletic glove pocket forming device which is of a durable and reliable construction.

An even further object of the present invention is to provide a new athletic glove pocket forming device which is susceptible of a low cost of manufacture with regard to both materials and labor, and which accordingly is then susceptible of low prices of sale to the consuming public, thereby making such athletic glove pocket forming device economically available to the buying public.

Still yet another object of the present invention is to provide a new athletic glove pocket forming device which provides in the apparatuses and methods of the prior art some of the advantages thereof, while simultaneously overcoming some of the disadvantages normally associated therewith.

Still another object of the present invention is to provide a new athletic glove pocket forming device for facilitating the formation of a pocket in an athletic glove.

Yet another object of the present invention is to provide a new athletic glove pocket forming device which includes an elastomeric panel member having a plurality of coupling members on opposing edges such that the panel member is designed for being wrapped around an athletic glove having a ball in the pocket portion for the purpose of better forming a pocket portion or protecting the glove from the environment.

Still yet another object of the present invention is to provide a new athletic glove pocket forming device that fully conforms to any size glove and more efficiently and effectively breaking in a new glove.

Even still another object of the present invention is to provide a new athletic glove pocket forming device that protects the glove from the elements.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
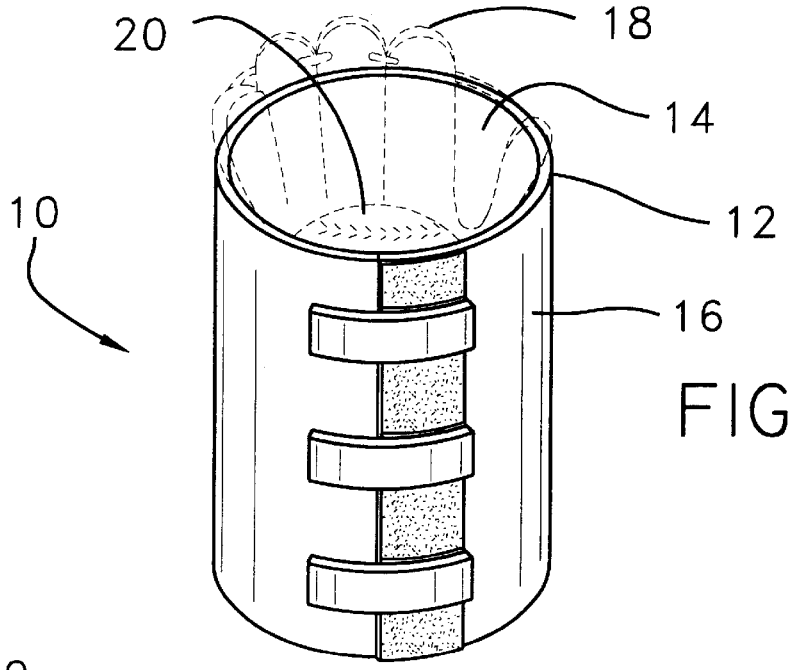
FIG. 1 is a perspective view of a new athletic glove pocket forming device according to the present invention.
Figure 2:
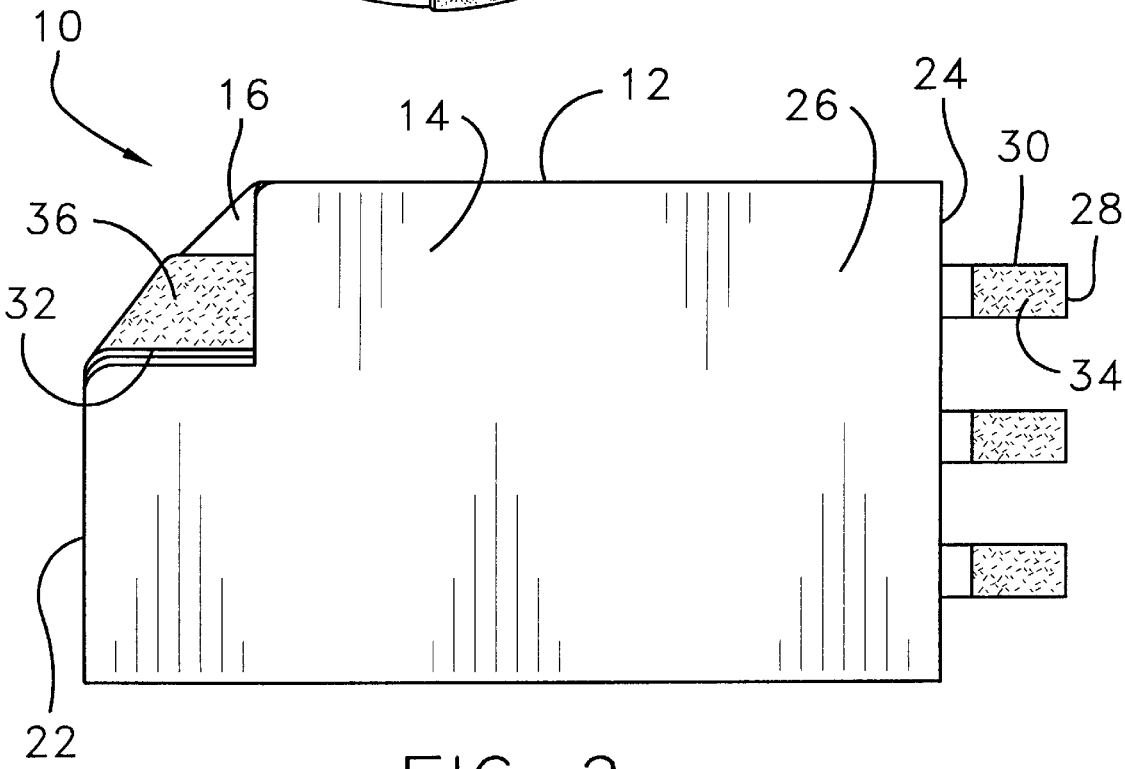
FIG. 2 is an inner view of the present invention.

With reference now to the drawings, and in particular to FIGS. 1 and 2 thereof, a new athletic glove pocket forming device embodying the principles and concepts of the present invention and generally designated by the reference numeral 10 will be described.

As best illustrated in FIGS. 1 and 2, the athletic glove pocket forming device 10 generally comprises a panel member 12 that has an interior surface 14 and an exterior surface 16. The interior surface 14 of the panel member 12 is designed for engaging the athletic glove 18. The panel member 12 is designed for conforming the athletic glove 18 around a ball 20 such that the ball 20 facilitates forming a pocket in the athletic glove 18.

The panel member 12 has a first end 22 and a second end 24. The first end 22 of the panel member 12 is couplable to the second end 24 of the panel member 12 such that the panel member 12 is secured around the athletic glove 18 and ball 20.

The panel member 12 has a width. The width of the panel member 12 is substantially equal to a length of the athletic glove 18 such that the panel member 12 is designed for engaging along the length of the athletic glove 18 for even pressure when forming a pocket in the athletic glove 18.

The panel member 12 comprises an elastomeric material 26. The elastomeric material 26 is designed for conforming around the athletic glove 18 when the panel member 12 is secured around the athletic glove 18.

The elastomeric material 26 of panel member 12 inhibits ultra-violet radiation from reaching the athletic glove 18 such that the panel member 12 inhibits fading and degradation of the athletic glove 18 when the panel member 12 is extended around the athletic glove 18 and secured.

The second end 24 of the panel member 12 has a plurality of securing tabs 28. Each of the securing tabs 28 extend outwardly from the second end 24 of the panel member. Each of the securing tabs 28 is designed for selectively coupling to the first end 22 of the panel member 12 when the panel member 12 is secured around the athletic glove 18.

Each of the securing tabs 28 of the second end 24 of the panel member 12 has a first fastener portion 30. The first end 22 of the panel member 12 has a second fastener portion 32. The first fastener portion 30 of each of the securing tabs 28 is selectively couplable to the second fastener portion 32 of the first end 22 of the panel member.

The first fastener portion 30 of each of the securing tabs 28 comprises a first portion of a hook and loop fastener 34. The second fastener portion 32 of the first end 22 of the panel member 12 comprises a second portion of a hook and loop fastener 36. The first portion of a hook and loop fastener 34 is complimentary to the second portion of a hook and loop fastener 36. The first portion of a hook and loop fastener 34 is selectively couplable to the second portion of the hook and loop fastener, thereby allowing the user to selectively secure the panel member 12 around the glove.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An athletic glove pocket forming device for helping to form a pocket in an athletic glove, the athletic glove pocket forming device comprising:

a panel member for wrapping about the athletic glove, said panel member having an interior surface and an exterior surface, said interior surface of said panel member being adapted for engaging the athletic glove when said panel member is wrapped about the athletic glove, said panel member having a first end portion and a second end portion, said panel member having a pair of side edges each extending along and between the first and second end portions of said panel member, said panel member having a pair of end edges extending between said side edges; and adjustable coupling means for adjustably coupling the first end portion of said panel member to the second end portion of said panel member to form said panel member into a substantially cylindrical shape about the athletic glove, said adjustable coupling means being adjustable to adjust a diameter of the substantially cylindrical shape being formed about the athletic glove, said adjustable coupling means being located at discrete, spaced locations on said second end portion between said side edges and being substantially continuous on said first end portion between said side edges.

2. The athletic glove pocket forming device as set forth in claim 1, wherein said panel member has a width between said side edges of said panel member, said width of said panel member being substantially equal to a length of the athletic glove measured between a hand entry opening in the athletic glove and a tip of one finger portion of the athletic glove such that said panel member is adapted for engaging the athletic glove along an entire length of the athletic glove between the hand entry opening and the tip of the finger for facilitating the application of even pressure to the athletic glove by said panel member.

3. The athletic glove pocket forming device as set forth in claim 1, wherein said panel member comprises an elastomeric material for conforming around the athletic glove when said panel member is secured around the athletic glove, said elastomeric material of said panel member inhibiting passage of ultra-violet radiation therethrough such that the radiation is inhibited from reaching the athletic glove for reducing fading and degradation of the athletic glove when said panel member is extended around the athletic glove.

4. The athletic glove pocket forming device as set forth in claim 1, wherein said adjustable coupling means comprises a plurality of securing tabs, each of said securing tabs outwardly extending from said second end portion of said panel member, each of said securing tabs being adapted for selectively coupling to said first end portion of said panel member when said panel member is extended around the athletic glove.

5. The athletic glove pocket forming device as set forth in claim 4, wherein each of said securing tabs has a first fastener portion, and said first end portion of said panel member having a second fastener portion, said first fastener portion of each of said securing tabs being selectively couplable to said second fastener portion of said first end portion of said panel member.

6. The athletic glove pocket forming device as set forth in claim 5, wherein said first fastener portion of each of said securing tabs comprises a first portion of a hook and loop fastener, said second fastener portion of said first end portion of said panel member comprises a second portion of a hook and loop fastener, said first portion of a hook and loop fastener being complimentary to said second portion of a hook and loop fastener such that said first portion of a hook and loop fastener is selectively couplable to said second portion of a hook and loop fastener.

7. The athletic glove pocket forming device as set forth in claim 5, wherein said second fastener portion on said first end portion of said panel member extends substantially the entire distance between said side edges of said panel member such that said first fastener portions on said securing tabs are securable to said second fastener portion at any position between said side edges.

8. The athletic glove pocket forming device as set forth in claim 4, wherein said plurality of securing tabs are substantially uniformly spaced along said end edge at said second end portion of said panel member.

9. The athletic glove pocket forming device as set forth in claim 4, wherein said plurality of securing tabs comprises three of said securing tabs.

10. The athletic glove pocket forming device as set forth in claim 1, wherein a length of said panel member between said side edges is approximately 60 percent of a length of said member between said end edges.

11. The athletic glove pocket forming device as set forth in claim 1, wherein said panel member is rectangular and said side edges and said end edges are substantially straight.

12. An athletic glove pocket forming device for helping to form a pocket in an athletic glove, the athletic glove pocket forming device comprising:

a panel member for wrapping about the athletic glove, said panel member having an interior surface and an exterior surface, said interior surface of said panel member being adapted for engaging the athletic glove when said panel member is wrapped about the athletic glove, said panel member having a first end portion and a second end portion, said panel member having a pair of side edges each extending along and between the first and second end portions of said panel member, said panel member having a pair of end edges extending between said side edges; and adjustable coupling means for adjustably coupling the first end portion of said panel member to the second end portion of said panel member to form said panel member into a substantially cylindrical shape about the athletic glove, said adjustable coupling means being adjustable to adjust a diameter of the substantially cylindrical shape being formed about the athletic glove, said adjustable coupling means being located at discrete, spaced locations on said second end portion between said side edges and being substantially continuous on said first end portion between said side edges;

wherein said panel member has a width between said side edges of said panel member, said width of said panel member being substantially equal to a length of the athletic glove measured between a hand entry opening in the athletic glove and a tip of one finger portion of the athletic glove such that said panel member is adapted for engaging the athletic glove along an entire length of the athletic glove between the hand entry opening and the tip of the finger for facilitating the application of even pressure to the athletic glove by said panel member;

wherein said panel member comprises an elastomeric material for conforming around the athletic glove when said panel member is secured around the athletic glove, said elastomeric material of said panel member inhibiting passage of ultra-violet radiation therethrough such that the radiation is inhibited from reaching the athletic glove for reducing fading and degradation of the athletic glove when said panel member is extended around the athletic glove;

wherein said adjustable coupling means comprises a plurality of securing tabs, each of said securing tabs outwardly extending from said second end portion of said panel member, each of said securing tabs being adapted for selectively coupling to said first end portion of said panel member when said panel member is extended around the athletic glove;

wherein each of said securing tabs has a first fastener portion, and said first end portion of said panel member having a second fastener portion, said first fastener portion of each of said securing tabs being selectively couplable to said second fastener portion of said first end portion of said panel member;

wherein said first fastener portion of each of said securing tabs comprises a first portion of a hook and loop fastener, said second fastener portion of said first end portion of said panel member comprises a second portion of a hook and loop fastener, said first portion of a hook and loop fastener being complimentary to said second portion of a hook and loop fastener such that said first portion of a hook and loop fastener is selectively couplable to said second portion of a hook and loop fastener;

wherein said second fastener portion on said first end portion of said panel member extends substantially the entire distance between said side edges of said panel member such that said first fastener portions on said securing tabs are securable to said second fastener portion at any position between said side edges;

wherein said plurality of securing tabs are substantially uniformly spaced along said end edge at said second end portion of said panel member;

wherein said plurality of securing tabs comprises three of said securing tabs;

wherein a length of said panel member between said side edges is approximately 60 percent of a length of said member between said end edges; and wherein said panel member is rectangular and said side edges and said end edges are substantially straight.

13. A system for forming a pocket in an athletic glove, said system comprising:

a ball;

an athletic glove having a palm portion with an entry opening and a plurality of finger portions each extending from said palm portion and each terminating in a tip, a length of said glove being defined between said entry opening of said palm portion and a said tip extending furthest from said entry opening; and a pocket forming device comprising:

a panel member for wrapping about said athletic glove, said panel member having an interior surface and an exterior surface, said interior surface of said panel member being adapted for engaging said athletic glove when said panel member is wrapped about said athletic glove, said panel member having a first end portion and a second end portion, said panel member having a pair of side edges each extending along and between the first and second end portions of said panel member, said panel member having a pair of end edges extending between said side edges; and adjustable coupling means for adjustably coupling the first end portion of said panel member to the second end portion of said panel member to form said panel member into a substantially cylindrical shape about said athletic glove, said adjustable coupling means being adjustable to adjust a diameter of the substantially cylindrical shape being formed about said athletic glove, said adjustable coupling means being located at discrete, spaced locations on said second end portion between said side edges and being substantially continuous on said first end portion between said side edges;

wherein said panel member has a width between said side edges of said panel member, said width of said panel member being substantially equal to said length of said athletic glove such that said panel member encompasses substantially the entire said athletic glove along the entire said length of said athletic glove between the hand entry opening and the tip of the finger for facilitating application of even pressure to said athletic glove by said panel member.

14. The system of claim 13 wherein said adjustable coupling means comprises a plurality of securing tabs, each of said securing tabs outwardly extending from said second end portion of said panel member, each of said securing tabs being adapted for selectively coupling to said first end portion of said panel member when said panel member is extended around the athletic glove.

15. The system of claim 14 wherein each of said securing tabs has a first fastener portion, and said first end portion of said panel member having a second fastener portion, said first fastener portion of each of said securing tabs being selectively couplable to said second fastener portion of said first end portion of said panel member.

16. The system of claim 15 wherein said first fastener portion of each of said securing tabs comprises a first portion of a hook and loop fastener, said second fastener portion of said first end portion of said panel member comprises a second portion of a hook and loop fastener, said first portion of a hook and loop fastener being complimentary to said second portion of a hook and loop fastener such that said first portion of a hook and loop fastener is selectively couplable to said second portion of a hook and loop fastener.

17. The system of claim 16 wherein said second fastener portion on said first end portion of said panel member extends substantially the entire distance between said side edges of said panel member such that said first fastener portions on said securing tabs are securable to said second fastener portion at any position between said side edges.

18. The system of claim 14 wherein said plurality of securing tabs are substantially uniformly spaced along said end edge at said second end portion of said panel member, and wherein said plurality of securing tabs comprises three of said securing tabs.

19. The system of claim 13 wherein a length of said panel member between said side edges is approximately 60 percent of a length of said member between said end edges, and wherein said panel member is rectangular and said side edges and said end edges are substantially straight.

* * * * *